US007026045B2

(12) United States Patent
Rettenbacher et al.

(10) Patent No.: US 7,026,045 B2
(45) Date of Patent: Apr. 11, 2006

(54) MULTILAYER COMPOSITE ARMOUR

(75) Inventors: Gottfried Rettenbacher, Handenberg (AT); Josef Reiter, Eggelsberg (AT); Franz Feuchtenschlager, Ranshofen (AT); Peter Schulz, Simbach (DE); Pierre-Francois Louvigne, Sceaux (FR)

(73) Assignees: ARC Leichtmetallkompetenzzentrum Ranshofen GmbH, Ranshofen (AT); Etat Francais Represente Par le Delegue General pour l'armement, Arcueil (FR)

( * ) Notice: Subject to any disclaimer, the term of this patent is extended or adjusted under 35 U.S.C. 154(b) by 155 days.

(21) Appl. No.: 10/483,221

(22) PCT Filed: Jul. 12, 2002

(86) PCT No.: PCT/FR02/02467

§ 371 (c)(1),
(2), (4) Date: Feb. 7, 2004

(87) PCT Pub. No.: WO03/012363

PCT Pub. Date: Feb. 13, 2003

(65) Prior Publication Data

US 2004/0255768 A1 Dec. 23, 2004

(30) Foreign Application Priority Data

Jul. 12, 2001 (FR) ..... 01 09261

(51) Int. Cl.
*B32B 3/06* (2006.01)

(52) U.S. Cl. ..... 428/306.6; 428/307.7; 428/315.9; 428/195; 428/71.73; 428/911; 89/36.02; 89/36.04; 89/36.01

(58) Field of Classification Search ..... 428/306.6, 428/307.7, 315.9, 195, 71, 73, 911; 89/36.02, 89/36.04, 36.01
See application file for complete search history.

(56) References Cited

U.S. PATENT DOCUMENTS

| | | | |
|---|---|---|---|
| 3,705,558 | A | 12/1972 | McDougal et al. |
| 4,158,338 | A | 6/1979 | Dippold et al. |
| 4,415,632 | A | 11/1983 | Luhleich et al. |
| 4,534,266 | A | 8/1985 | Huet |
| 5,194,202 | A | 3/1993 | Yun et al. |

FOREIGN PATENT DOCUMENTS

| | | |
|---|---|---|
| DE | 38 37 378 A 1 | 2/1990 |
| DE | 39 24 267 C 1 | 12/1994 |

OTHER PUBLICATIONS

Translation of DE -3837378.*

* cited by examiner

*Primary Examiner*—Ling Xu
(74) *Attorney, Agent, or Firm*—Oliff & Berridge, PLC

(57) ABSTRACT

The invention relates to the area of armor and in particular to multilayer armor having a composite layer containing a first material made of a metal or an alloy and a second material where the second material is porous and in that the metal or metal alloy is infiltrated into some or all of the pores of the second material and characterized in that a cage made of plates having openings contains the first and second materials and in that the cage is itself coated, at least partly, with the infiltration metal or alloy, the melting point of the cage material being higher than that of the infiltration metal or alloy.

20 Claims, 5 Drawing Sheets

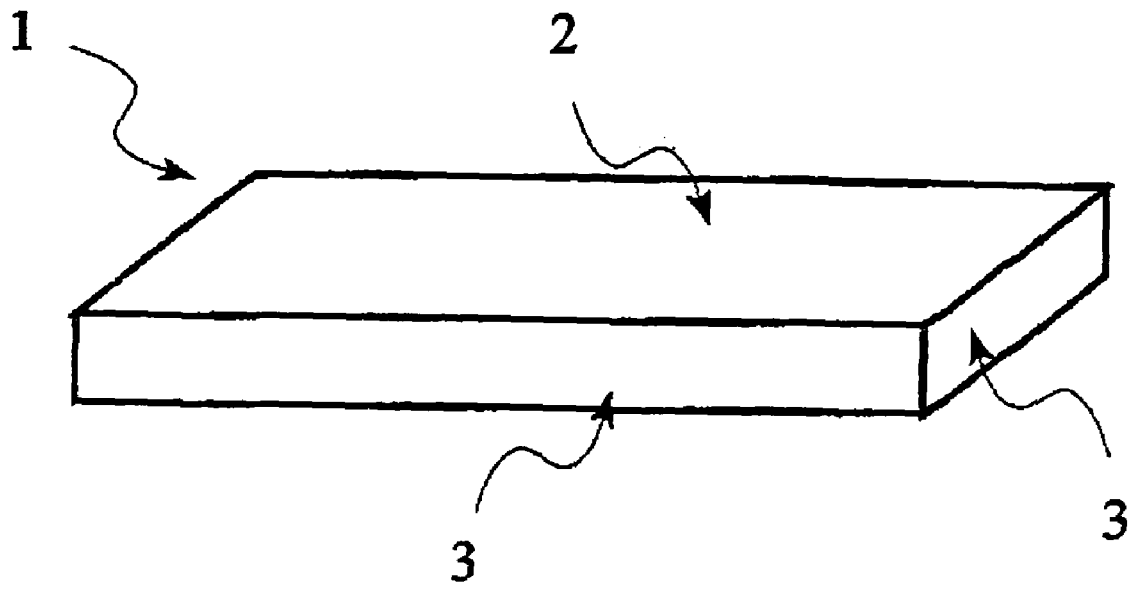
figure N°1

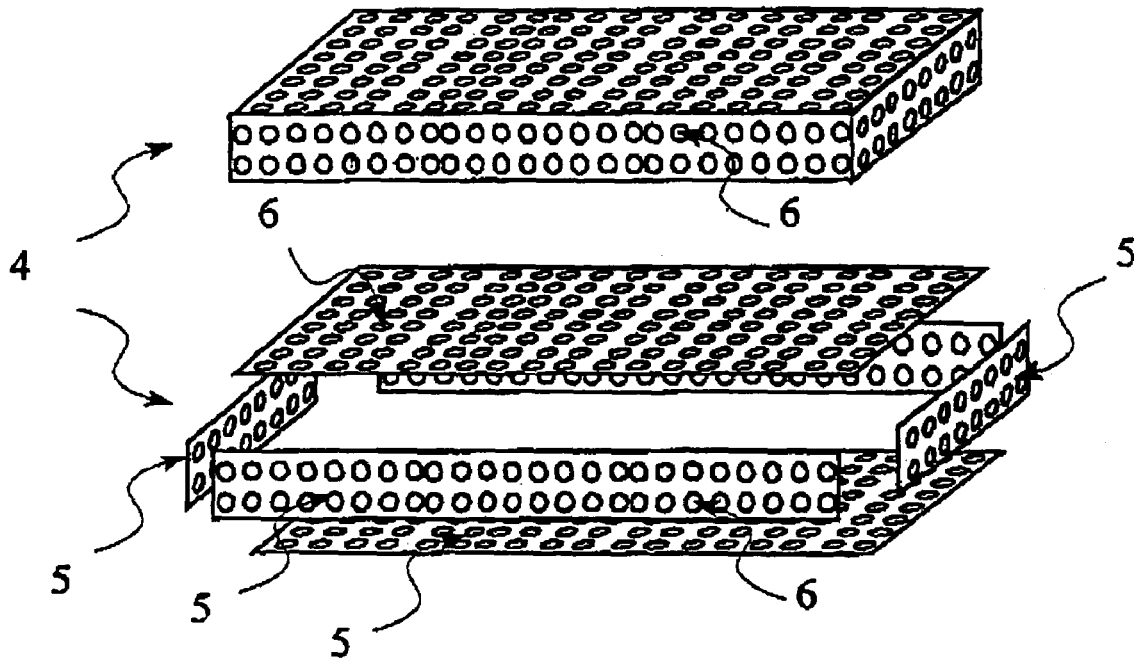
figure N°2

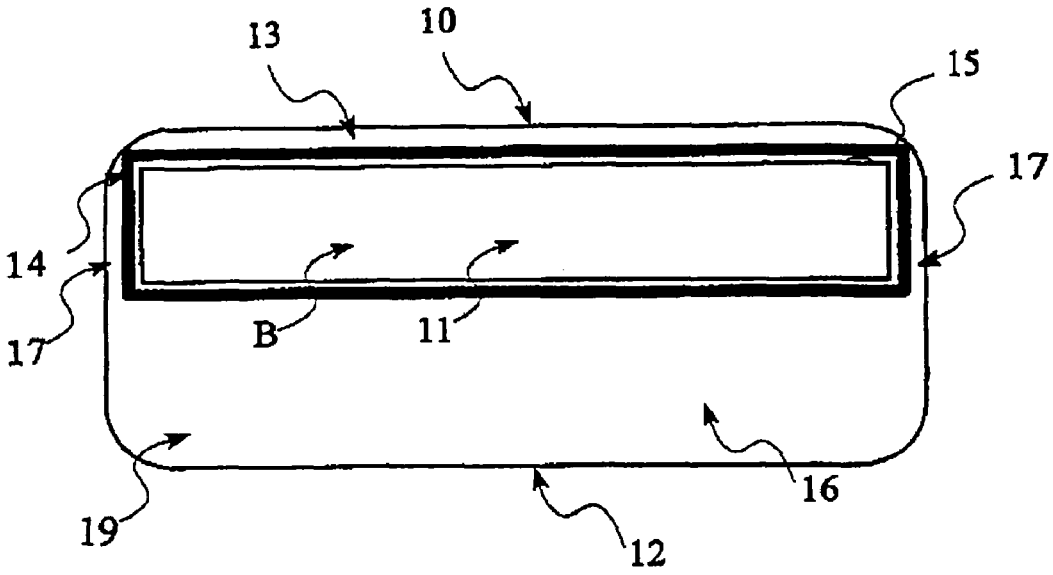
figure N°3
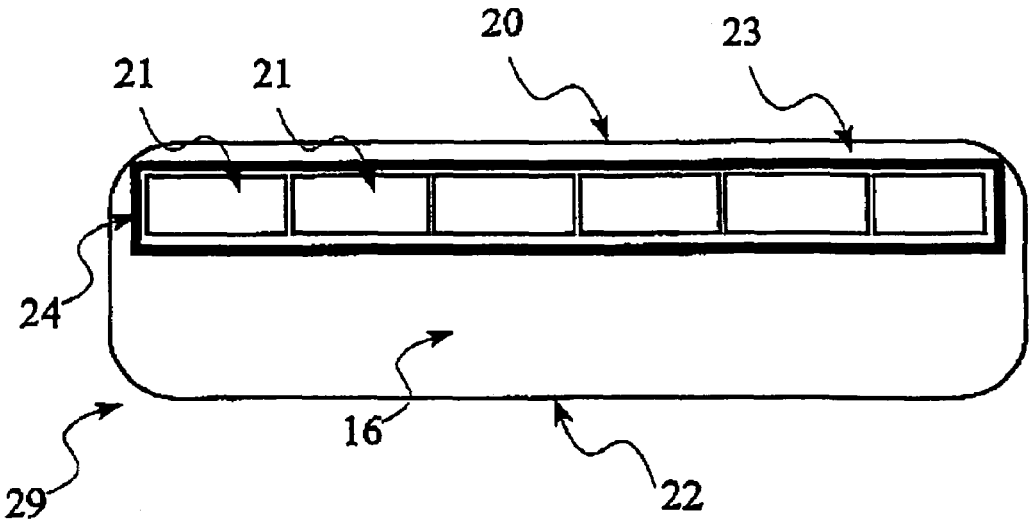
figure N°4

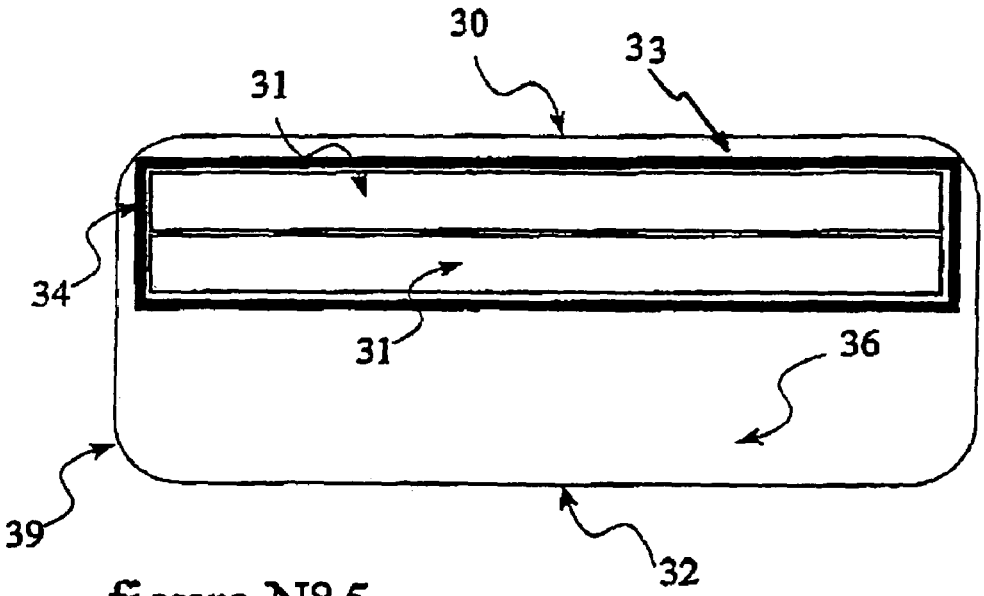
figure N° 5
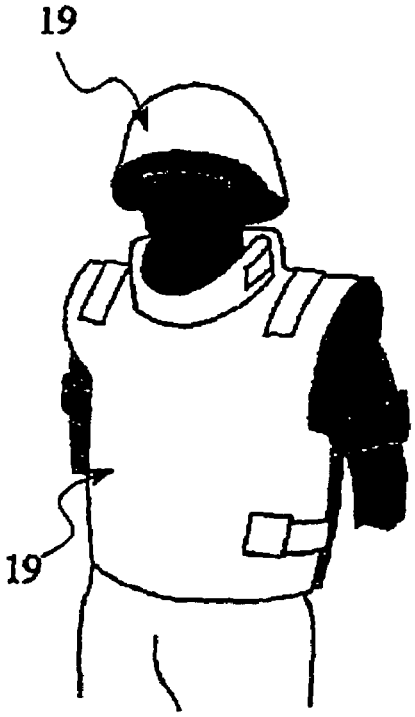
figure N°6

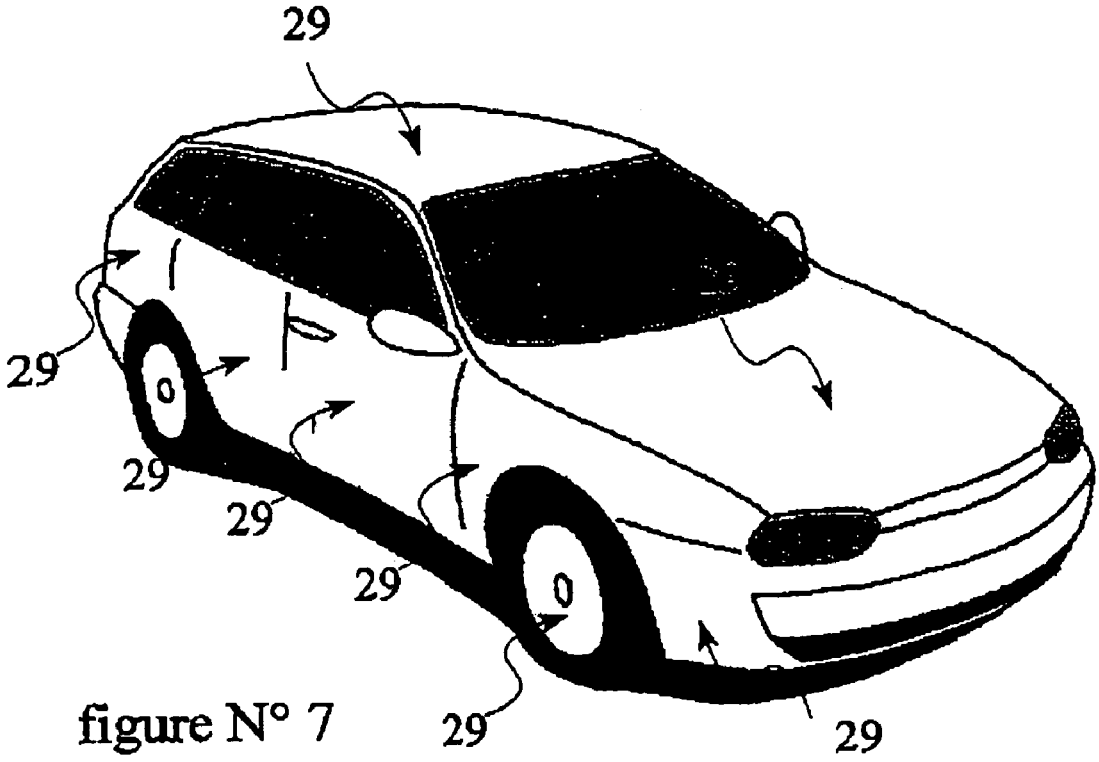
figure N° 7
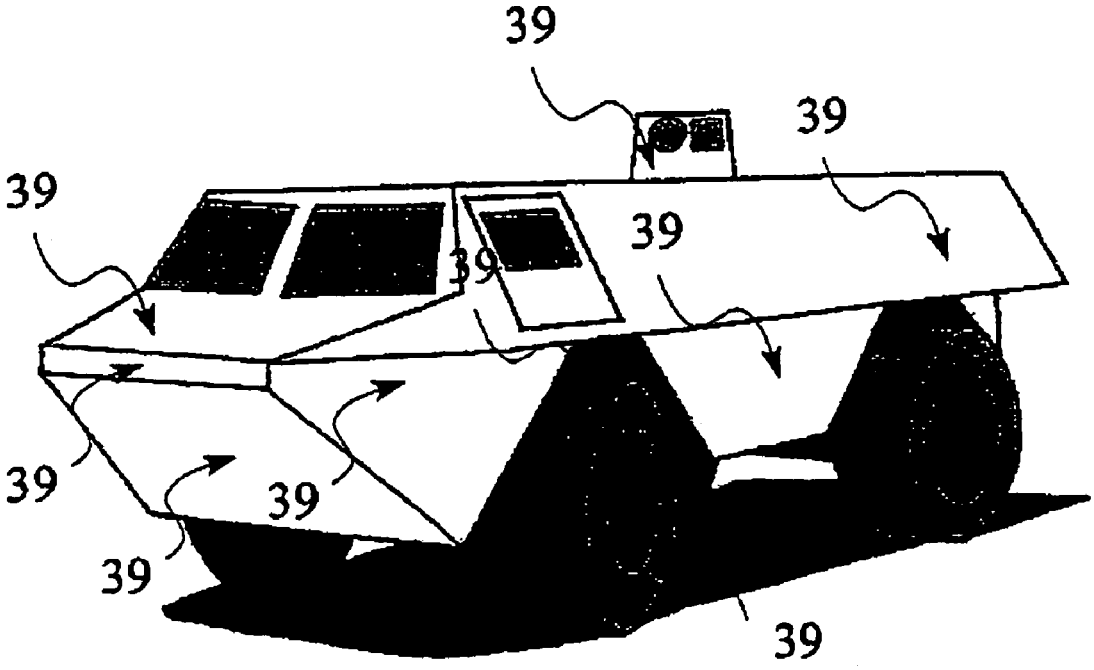
figure N° 8

MULTILAYER COMPOSITE ARMOUR

BACKGROUND OF THE INVENTION

The invention relates to the area of armor and in particular multilayer armor having a composite layer containing a first material, for example a ceramic, and a second material, such as a metal or metal alloy.

Ceramic has been known for its ballistic performance for a number of years, either as a material placed at the front face of a piece of armor or embedded in the metal material to increase overall armor effectiveness.

The most significant work in the area of cast composite armor has related mainly to production of armor with a series of ceramic reinforcements distributed in a metal matrix, generally obtained by a process related to casting.

These types of armor, although their performance is satisfactory, are generally difficult to fabricate and do not have guaranteed protection effectiveness that is identical for all angles of attack, for all impact points on the front face, and also have low performance with multiple impacts (two successive shots striking the same impact zone).

Moreover, in view of the nature and shape of the reinforcement bodies used, and in view of the implementation difficulties, the cost of the protection thus obtained is generally high by comparison to armor composed of monolithic materials.

Finally, the exceptional compressive strength performance of ceramics is not fully exploited due to the confinement configurations recommended by the various inventors, which do not exhibit an optimal configuration.

For example, McDougal et al., in their U.S. Pat. No. 3,705,558, provide a light armor composed of a layer of ceramic balls placed in contact but such that a small gap between the balls allows for a liquid metal coating to pass through. Various configurations are then possible, such as, the ceramic balls are enclosed in a stainless steel pouch, or they are covered with a nickel layer and then attached to an aluminum plate. The technique proposed by McDougal et al. has been criticized for its implementation difficulty and the risk inherent in the process of damaging the ceramic by thermal shock during the liquid metal coating phase. Moreover, in the casting phase, the technique recommended by McDougal et al. sometimes leads to unwanted movement of one ball relative to another. This unexpected movement affects armor effectiveness locally, and for this reason U.S. Pat. No. 4,158,338 describes a strong wall panel containing hard, and thus, nonporous ceramic particles, disposed during manufacture in a cage that holds them in position, and having holes through which is injected a liquefied elastomer whose temperature is unable to damage the ceramic particles. U.S. Pat. No. 4,534,266, which describes a method of obtaining a regular network of interconnected metal spheres that receive ceramic inserts subsequently embedded by the liquid metal during the casting stage, is also known.

Other patents, such as, for example, U.S. Pat. No. 5,194,202, U.S. Pat. No. 4,415,632, DE 3924267, and DE 3837378 describe armor having a composite layer containing a first material composed of a metal or metal alloy and a second material and characterized in that the second material is porous and in that the metal or the alloy is infiltrated into all or some of the pores of the second material.

However, such an armor cracks when struck by a projectile and when other plates made of metal, for example, are associated therewith by cementing or welding, separations occur between the plates which is detrimental to the integrity and strength of the whole or the welds break due to shear forces, leading once again to a reduction in the integrity and strength of the whole.

SUMMARY OF THE INVENTION

The goal of the invention is to remedy the aforesaid difficulties by providing a light, effective armor that is easy to fabricate, has unparalleled integration flexibility, and has no weaknesses in integrity or strength in the event of cracking of the composite layer.

The solution provided is a multilayer armor having a composite layer containing a first material made of a metal or an alloy and a second material where the second material is porous and the metal or the metal alloy is infiltrated into some or all of the pores of the second material, wherein a cage made of plates having openings contains the first and second materials and in that the cage itself is coated, at least partly, with the infiltration metal or alloy, the melting point of the cage material being higher than that of the infiltration metal or alloy.

According to another additional feature, the cage is entirely coated with the infiltration metal or alloy.

According to another feature, the void ratio of the ceramic is between 0.1% and 80%.

According to another feature, the ceramic is partly or entirely comprised of at least one of the following ceramics: recrystallized SiC and/or other types of ceramics, such as SiC—SiN, SiC—$SiO_2$, SiN, $Al_2O_3$, AlN, and $Si_3N_4$.

According to a particular feature, the ceramic is partly or entirely comprised of recrystallized silicon carbide.

According to another feature, the cage contains several superimposed or juxtaposed reinforcing bodies made of infiltrated porous ceramic.

According to another feature, the cage is made of metal or alloy.

According to a particular feature, the cage is made partly or entirely of one of the following metals or their alloys: iron, steel, copper, zinc, aluminum, magnesium, beryllium, or titanium.

According to one feature, the metal or the alloy infiltrated into the pores of the ceramic is made partly or entirely of aluminum, magnesium, beryllium, or titanium.

BRIEF DESCRIPTION OF THE DRAWINGS

Other advantages and features of the invention will appear in the description of various embodiments of the invention with reference to the attached figures:

FIG. 1 is a perspective view of one example of a porous reinforcing body designed to enter into the composition of armor according to the invention;

FIG. 2 is a perspective view of one example of a metal cage designed to contain the porous reinforcing body;

FIG. 3 is a vertical section through a first embodiment of armor in which the porous reinforcing body forms only one body in the cage;

FIG. 4 is a vertical section through a second embodiment of armor containing several juxtaposed porous reinforcing bodies;

FIG. 5 is a vertical section through a third embodiment of armor containing several superimposed porous reinforcing bodies;

FIG. 6 shows one application of the invention for protection of a person;

FIG. 7 shows one application of the invention to a vehicle for protection of its occupants; and FIG. 8 shows one application of the invention to an armored vehicle for protection of its occupants.

DETAILED DESCRIPTION OF THE PREFERRED EMBODIMENTS

FIG. 1 is a perspective view of an example of a body 1 made of porous reinforcing material designed to enter into the composition of the armor. This body 1 is parallelepipedic in shape and is a ceramic. It is made of recrystallized silicon carbide. Its void ratio is 15%. This body has two large transverse surfaces 2 and small lateral surfaces 3.

FIG. 2 is a perspective view of an example of a metal cage 4 designed to enclose said body 1 made of porous reinforcing material. This cage 4 is composed of steel plates 5 having regularly disposed circular openings 6. These plates 5 are welded together to form a cage 4 inside which the body 1 made of porous reinforcing material can be positioned, at least one of the faces of the parallelepiped being welded once the porous body 1 has been placed inside cage 4.

The dimensions of the cage 4 and the porous body 1 are such that there is several millimeters or even more of play between one of the transverse faces 2 of the porous body and the corresponding inside lateral face of cage 4. On the other hand, the play is practically zero between the lateral surfaces 3 of porous body 1 and the corresponding inside surfaces of cage 4.

FIG. 3 is a vertical section through an example of armor 19 wherein the face exposed to the munition is called the front face 10 while the opposite face 12 is called the rear face.

The armor 19 is of the multilayer composite type. It has a first layer 13 that is thin—several millimeters—and made of infiltration metal, in this case aluminum, then a composite 15 layer comprised of a cage 14 containing a porous reinforcing body 11 made of recrystallized silicon carbide infiltrated and coated with the infiltration metal, and finally a third layer 16 that is thick—several centimeters—consisting of infiltration metal.

It will be noted that the porous ceramic infiltration metal not only infiltrates the pores of the ceramic but also coats the composite 15, the thickness of this coating being small on the front face 10 and the lateral faces 17 of cage 14 and thick on the rear face 12 of the armor.

FIG. 4 is a vertical section through another example of an armor 29 according to the invention.

The face exposed to the munition is called the front face 20 while the opposite face 22 is called the rear face.

This armor 29 is of the multilayer composite type. It has a first layer 23 that is thin—several millimeters thick—and made of infiltration metal, in this case magnesium, then a composite comprised of a cage 24 containing several juxtaposed porous reinforcing bodies 21 made of alumina $Al_2O_3$ infiltrated and coated with the infiltration metal, and finally a third layer 16 that is thick—several centimeters—consisting of infiltration metal.

FIG. 5 is a vertical section through another example of an armor 39 according to the invention.

The face exposed to the munition is called the front face 30 while the opposite face 32 is called the rear face.

This armor 39 is of the multilayer composite type. It has a first layer 33 that is thin—several millimeters thick—and made of infiltration metal, in this case titanium, then a composite comprised of a cage 34 containing several superimposed porous reinforcing bodies 31, one made of recrystallized silicon carbide with a void ratio of 21% and the other of $Si_3N_4$ with a void ratio of 11%, both being infiltrated and coated with the infiltration metal, and finally a third layer 36 that is thick—several centimeters—made of infiltration metal.

The components entering into the fabrication of the invention are deliberately chosen from the family of mass-produced industrial products to attain the objective of low cost while meeting the objectives of performance, weight, ease of integration, and resistance to multi-impacting presented above.

Thus, the material of the porous ceramic reinforcing body may, for example, be recrystallized silicon carbide (SiC) but also other types of ceramics, such as SiC—SiN, SiC—$SiO_2$, SiN, $Al_2O_3$, AlN, and $Si_3N_4$. The porosity of the reinforcing body must enable the infiltration metal to penetrate most or all of the pores to create an intimate bond between the two components and establish a state of local residual stresses generated by the differences in coefficient of thermal expansion between the ceramic and the infiltration metal. Because the coefficient of thermal expansion of the ceramic is extremely low (a few $10^{-6}$/K), the ceramic material infiltrated by a metal (whose expansion coefficient is between 2 and 10 times higher) has its expansion coefficient fixed almost solely by the ceramic, which generates internal stresses in the material. The void ratio may typically be about 10 to 20%, but good performance may also be achieved with lower void ratios, typically 10% and down to values less than 0.1%, or, on the contrary, higher such as 20 to 40%, for example. The void ratio, as explained above, is directly linked to the level of internal stresses reached in the ceramic after infiltration by the metal and is, hence, to some degree linked to the ballistic performance of the armor when impacted by a given munition. The armor will thus be optimized for a specific aggressor by choosing the most suitable void ratio.

The reinforcing material is contained in a cage. This cage is made of a steel-type metal alloy so that it is easy to fabricate (in particular the material is weldable) and inexpensive. However, other metals, such as copper, zinc, iron, aluminum, magnesium, beryllium, or titanium or another other similar metal or an alloy of these metals, can be used for fabricating the cage as long as the chemical and physical compatibilities between the reinforcing material, the cage, and the infiltration metal permit. The cage must be designed to contain the reinforcing material and easily enable passage of the liquid metal during the infiltration phase. Further, the melting point of the material of which the cage is made must be greater than the melting point of the infiltration metal or alloy.

The cage has a dual role. During the armor fabrication phase, the cage enables the reinforcing material to be located in one part of the mold, and prevents the reinforcing material from cracking by a confinement effect when the armor is impacted by the munition. When a projectile strikes the ceramic/metal or alloy composite, the latter may be cracked; the presence of the plates of which the cage is made limits expansion of the composite, hence the likelihood that it will crack is reduced, and even if it should crack, the cage deflects the crack, propagating it to the nearest opening in the cage. Thus, cracking is very limited and the integrity of the armor is unimpaired.

It should be noted that for deflection of the crack to occur, the ratio between the surface areas of openings 6 to that of the cage 4, namely its front, rear, and lateral faces, must be less than 75%.

The infiltration material is preferably a low-density metal or an alloy of the low-density metal, such as aluminum, magnesium, or beryllium, but, for certain armor configurations, it may be useful to employ other metals or alloys of these metals.

The invention calls for the cage containing the reinforcing material to be fully embedded in the infiltration material. It is preferable to locate the cage containing the reinforcing material near the front face of the armor (namely the face supposed to undergo impact by the munition) while taking care to provide a thin layer of infiltration material between the armor surface and the cage. The armor may be designed with a fairly large volume of infiltration material at the rear face (namely the side opposite the side attacked) so that this material can deform by a plastic deformation process and eventually absorb the incident energy of the projectile.

The armor presented here is made by any known infiltration process such as for example squeeze casting, casting, and pressure infiltration (plunger or gas). In all these processes, the infiltration material is first heated to melting point to acquire sufficient fluidity and is then placed in the presence of the cage containing the reinforcing material. Pressure application, and preheating the reinforcing material, are two methods of facilitating infiltration of the metal into the reinforcement.

One method of manufacturing armor 19 according to the invention can be the following:

aluminum metal is heated in a furnace until the metal melts;

a metal cage is prepared in two weldable steel half-shells provided with many holes;

a porous recrystallized SiC ceramic plate is cut to dimensions slightly less than those of the cage;

the SiC ceramic plate is inserted into the cage then closed with several weld spots;

the cage+SiC ceramic plate assembly is preheated in a furnace;

the cage+SiC ceramic plate assembly is inserted into a squeeze casting mold;

liquid metal is poured over the cage+SiC ceramic plate assembly and pressure is applied to facilitate penetration of the liquid metal into the pores of the SiC ceramic plate and through the cage;

the assembly is cooled under controlled-temperature conditions; and the assembly is unmolded.

This process has also been used to make an armor plate according to the invention with the goal of protecting part of a light vehicle. The reinforcing material used is in the form of three porous ceramic plates whose specifications are given below:

Type of ceramic: recrystallized silicon carbide (SiC);

Density: 2.6 to 2.7 g/cm$^3$;

Void ratio: 15 to 19%;

Tensile strength at 20° C.: 90 to 100 Mpa;

Tensile strength at 1300° C.: 100 to 110 Mpa;

Young's modulus: 230 Gpa;

Thermal conductivity: 30 W/m/K;

Coefficient of thermal expansion: $10^{-6}$/K; and

Plate size: 150 mm×75 mm×8 mm.

This ceramic is a widely available product used, in particular, as an abrasion material for milling industrial tools.

The cage is obtained by bending and welding a 2 mm thick weldable steel sheet provided with circular holes. The dimensions of the cage are 152 mm×77 mm×26 mm so that it can accept the three ceramic plates.

The infiltration material used is a classical foundry alloy of the aluminum-silicon type. The technique used for the casting phase is squeeze casting.

Armor according to the invention can be dimensioned to protect a person directly when used, for example, as a bullet-proof vest and as a helmet as shown in FIG. 6, or to protect land systems such as wheeled vehicles, tracked vehicles, shelters, infrastructures, movable bridges, etc. as shown in FIGS. 7 and 8, or flying craft such as airplanes, helicopters, drones, missiles, etc., or marine systems such as surface ships, submarines, crossing equipment, etc. against all types of projectiles, fragments, and shards.

The invention thus includes any type of composite armor and ballistic armor containing one or more porous ceramic bodies enclosed in a metal cage, the entire assembly being infiltrated with a metal.

Depending on the application in view, the dimensioning of the solution may combine variants of the following parameters:

- nature of infiltration metal material;
- nature of porous reinforcing material;
- nature of metal material of which the cage is composed;
- dimensions of porous reinforcing material;
- number of elements of porous reinforcing material enclosed in the cage;
- dimensions of cage (thickness of cage walls may be infinitely small);
- proportions of the various components in terms of weight and volume; and
- armor geometry (may be parallelepipedic, curved, tubular, or other).

Several elements must be taken into consideration to illustrate the value of the invention.

First, a weight advantage. The components of the invention enable the armor to be ranked as light armor comparable in performance to the reference aluminum armor (7020 alloy). Traditional protection solutions for light vehicles, such as automobiles, combat vehicles, transport vehicles, airplanes, helicopters, etc., employ panels several millimeters thick made of steel or titanium, and are hence heavier than the proposed solution.

The second advantage resides in the performance of the invention against an extensive threat range. Of course, depending on the formulation used for the armor, it can be tailored to the type of threat by adjusting the weight-performance ratio. However, for a standard formulation, such as that referred to above, the armor plate provides total protection against projectiles of any weight with impact velocities of 500 to 1000 meters/second. Moreover, this formulation is well below the 40 to 100 kg/m$^2$ range. This range corresponds to the weight of the protective equipment normally used on light vehicles.

The third advantage has to do with the integration flexibility of the invention. In its standard formulation, the armor can assume all the usual integration configurations of classical armor, namely:

the armor can be "applied," i.e. applied to the structure to be protected by any classical method, such as welding, cementing, bolting, adhesion, etc., as shown in FIG. 8;

the armor can be built directly into the structure for parts made by a casting method such as openers, hoods, bodies, fenders, doors, roofs, floors, wheel rims, etc., as shown in FIG. 7; and in the case of the "bullet-proof vest" or "flexible armor" type applications, the protection can easily be integrated into a classical garment configuration by a mosaic of plates, as shown in FIG. 5.

The fourth advantage of the invention is cost-related. The invention uses low-cost components and a low-cost manufacturing technique and procedure enabling mass production with no particular production constraints.

The fifth advantage resides in the ability of the invention to provide total protection even in the case of successive impacts on a single armor area (multi-impacting).

With regard to the particular case of flexible armor of the "bullet-proof vest" type as described for example in U.S. Pat. Nos. 4,090,005 and 5,972,819, it is known that for the highest aggression levels the risks of injury are high for the wearer of the protection even though the munition is stopped. This damage is due to the effects of indentation of the vest into the body, caused by insufficient distribution of the impact force over the surface. The present invention limits these risks of rear-face damage by distributing the impact force widely.

Of course, numerous modifications may be made to the embodiment example described above without departing from the framework of the invention. Thus, a metal cage with an extremely small wall thickness may be used, and the same metal or metal alloy may be chosen for the infiltration material and for the cage.

The invention claimed is:

1. Multilayer armor, comprising:

a first material where the first material is porous;

a second material comprising a metal or a metal alloy; and a cage made of plates having openings, wherein the first material is mounted in the cage and the second material passes through the openings to infiltrate some or all of the pores of the first material and coats the cage, at least partly, with the second material, the melting point of the cage being higher than that of the second material.

2. Armor according to claim 1, wherein the cage is entirely coated with said second material.

3. Armor according to claim 2, wherein the cage has two principal faces and four lateral faces, wherein the thickness of the coating of the second material is greater on one of the principal faces than on the other principal face and greater than on the lateral faces.

4. Armor according to claim 3, wherein the thickest coating thickness is a few centimeters.

5. Armor according to claim 4, wherein the coating thickness on the lateral faces and on one of the principal surfaces is a few millimeters.

6. Armor according to claim 4, wherein the ratio between the surface area of openings to that of the cage is less than 75%.

7. Armor according to claim 6, wherein said second material is comprised of a ceramic whose void ratio is between 0.1% and 80%.

8. Armor according to claim 7, wherein the ceramic is partly or entirely comprised of at least one of the following ceramics: recrystallized (SiC) and other ceramics including SiC—SiN, SiC—$SiO_2$, SiN, $Al_2O_3$, AlN, and $Si_3N_4$.

9. Armor according to claim 3, wherein the coating thickness on the lateral faces and on one of the principal surfaces is a few millimeters.

10. Armor according to claim 3, wherein the cage is made partly or entirely of one of the following metals or their alloys comprised of iron, steel, copper, zinc, aluminum, magnesium, beryllium, or titanium.

11. Armor according to claim 2, wherein the ratio between the surface area of openings to that of the cage is less than 75%.

12. Armor according to claim 11, wherein the cage is made partly or entirely of one of the following metals or their alloys comprised of iron, steel, copper, zinc, aluminum, magnesium, beryllium, or titanium.

13. Armor according to claim 11, wherein said metal or said alloy infiltrated into the pores of the first material is made partly or entirely of a material comprised of aluminum, magnesium, beryllium, or titanium.

14. Armor according to claim 1, wherein said first material is comprised of a ceramic whose void ratio is between 0.1% and 80%.

15. Armor according to claim 14, wherein the ceramic is partly or entirely comprised of at least one of the following ceramics: recrystallized (SiC) and ceramics to include SiC—SiN, SiC—$SiO_2$, SiN, $Al_2O_3$, AlN, and $Si_3N_4$.

16. Armor according to claim 14, wherein the ceramic is partly or entirely comprised of recrystallized silicon carbide.

17. Armor according to claim 16, wherein the cage contains several superimposed or juxtaposed reinforcing bodies made of the ceramic.

18. Armor according to claim 1, wherein the cage contains several superimposed or juxtaposed reinforcing bodies made of the ceramic.

19. Armor according to claim 1, wherein the cage is made partly or entirely of one of the following metals or their alloys comprised of iron, steel, copper, zinc, aluminum, magnesium, beryllium, or titanium.

20. Armor according to claim 1, wherein said metal or said alloy infiltrated into the pores of the second material is made partly or entirely of a material comprised of aluminum, magnesium, beryllium, or titanium.

* * * * *